US006383099B1

(12) United States Patent
McMillan et al.

(10) Patent No.: US 6,383,099 B1
(45) Date of Patent: May 7, 2002

(54) TENNIS RACQUET

(75) Inventors: Willie McMillan, Bensenville; Po-Jen Cheng, Oak Brook, both of IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 08/438,767

(22) Filed: May 22, 1995

(51) Int. Cl.[7] ..... A63B 49/02
(52) U.S. Cl. ..... 473/537
(58) Field of Search ..... 273/73 R, 73 C, 273/73 D, 73 G; 473/537, 524

(56) References Cited

U.S. PATENT DOCUMENTS 4,664,380 A * 5/1987 Kuebler ..... 273/73 C
4,768,786 A * 9/1988 Kuebler ..... 273/73 C
4,997,186 A * 3/1991 Carr ..... 273/73 C
5,076,583 A * 12/1991 Hsu ..... 273/73 C
5,183,265 A * 2/1993 Umlauft et al. ..... 273/73 C
5,211,691 A * 5/1993 Sol ..... 273/73 C
5,310,179 A * 5/1994 Takatsuka ..... 273/73 C
5,368,295 A 11/1994 Severa
5,462,274 A * 10/1995 Takatsuka ..... 273/73 C
5,540,434 A * 7/1996 Garrett, Jr. et al. ..... 273/73 C

FOREIGN PATENT DOCUMENTS

CA 2049187 * 2/1992 ..... 273/73 R

* cited by examiner

*Primary Examiner*—Raleigh W. Chiu

(57) ABSTRACT

A tennis racquet is provided with increased resistance against twisting of the racquet frame by increasing the width of the frame just above the area where the yoke and Y-shaped arms of the throat merge with the U-shaped upper portion of the head. The width of the frame in that area is preferably at least 0.600 inch, and more preferably about 0.640 inch. The ratio of the width and the height is about 0.54. The increased resistance to twisting permits the frame to be wider, thereby increasing the maximum width of the strings, reducing the difference between the maximum string width and maximum string length, and increasing the polar moment of inertia of the racquet.

12 Claims, 3 Drawing Sheets

TENNIS RACQUET

BACKGROUND

This invention relates to tennis racquets, and, more particularly, to a tennis racquet having a frame with a cross sectional shape which optimizes the stiffness and torsion characteristics of the racquet.

The force applied by a tennis ball to a strung tennis racquet bends the racquet primarily in a plane which extends perpendicularly to the strung surface (primary mode bending). As the point of impact of the ball moves away from the longitudinal centerline of the racquet, the racquet tends to twist upon ball impact. This twisting or torsional movement increases as the distance of the point of impact from the longitudinal centerline increases. The bending and twisting causes deflection of the racquet, which reduces the power and accuracy that a player can impart to the ball.

Prior art tennis racquets designed to minimize bending and twisting often include a frame with an increased height when viewed in side elevation. Such racquets have increased stiffness in the primary bending mode, but they do not significantly reduce the twisting.

Kuebler U.S. Pat. No. 4,664,380 describes a dual taper beam tennis racquet. When viewed in side elevation, the frame has a maximum height in the area where the yoke portion and the Y-shaped throat portion merge with the inverted U-shaped portion of the head. The height decreases or tapers downwardly toward the top of the head and toward the handle, which is the basis of the "dual taper" description.

Wilson Sporting Goods Co. has sold a number of tennis racquets under the names Hammer and Sledge Hammer which have a dual taper. Some of the properties of those racquets are described in U.S. Pat. No. 5,368,295.

Wilson Sporting Goods Co. has also sold tennis racquets having the properties described in co-owned U.S. patent application Ser. No. 569,348, filed Aug. 21, 1990. Such racquets can be referred to as quad taper racquets because the width or thickness of the frame when viewed in plan also tapers in two directions. The maximum width of the frame is generally in the area of the maximum height, and the width decreases or tapers downwardly toward the top of the head and toward the handle.

Increased height of a racquet (viewed in side elevation) generally provides increased stiffness, i.e., resistance against primary mode bending. A circular cross section or a wider frame thickness (viewed in plan) provides increased torsion, i.e., resistance against twisting. However, a circular cross section is not as resistant to bending as a beam with a greater height.

The area of maximum twisting is generally just above the area where the yoke and Y-shaped arms of the throat merge with the inverted U-shaped portion of the head. In a dual taper or quad taper racquet frame, that area generally does not have enough width to provide optimum resistance to twisting. In a racquet having a round cross section, that area generally does not have enough height to provide optimum resistance to bending.

SUMMARY OF THE INVENTION

We have found that resistance against twisting of a tennis racquet frame can be increased by increasing the width of the frame, particularly just above the area where the yoke and Y-shaped arms of the throat merge with the inverted U-shaped portion of the head. Good resistance against both twisting and bending can be obtained by providing the frame with a more rectangular or boxier cross section having a greater width and smaller height than that of prior dual taper or quad taper racquets or other types of racquets in the area just above the merger of the yoke, Y-shaped throat, and the inverted U-shaped portion of the head. The width is preferably at least 0.600 inch, and more preferably at least about 0.640 inch. The ratio of the width and the height is at least 0.50, and more preferably at least about 0.54. The width of the cross section decreases toward the top of the head and toward the handle. The increased resistance to twisting permits the frame to be made wider, thereby increasing the maximum width of the strings and increasing the polar moment of inertia of the racquet. The more rectangular shape of the cross section provides better resistance against bending compared to an oval cross section.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
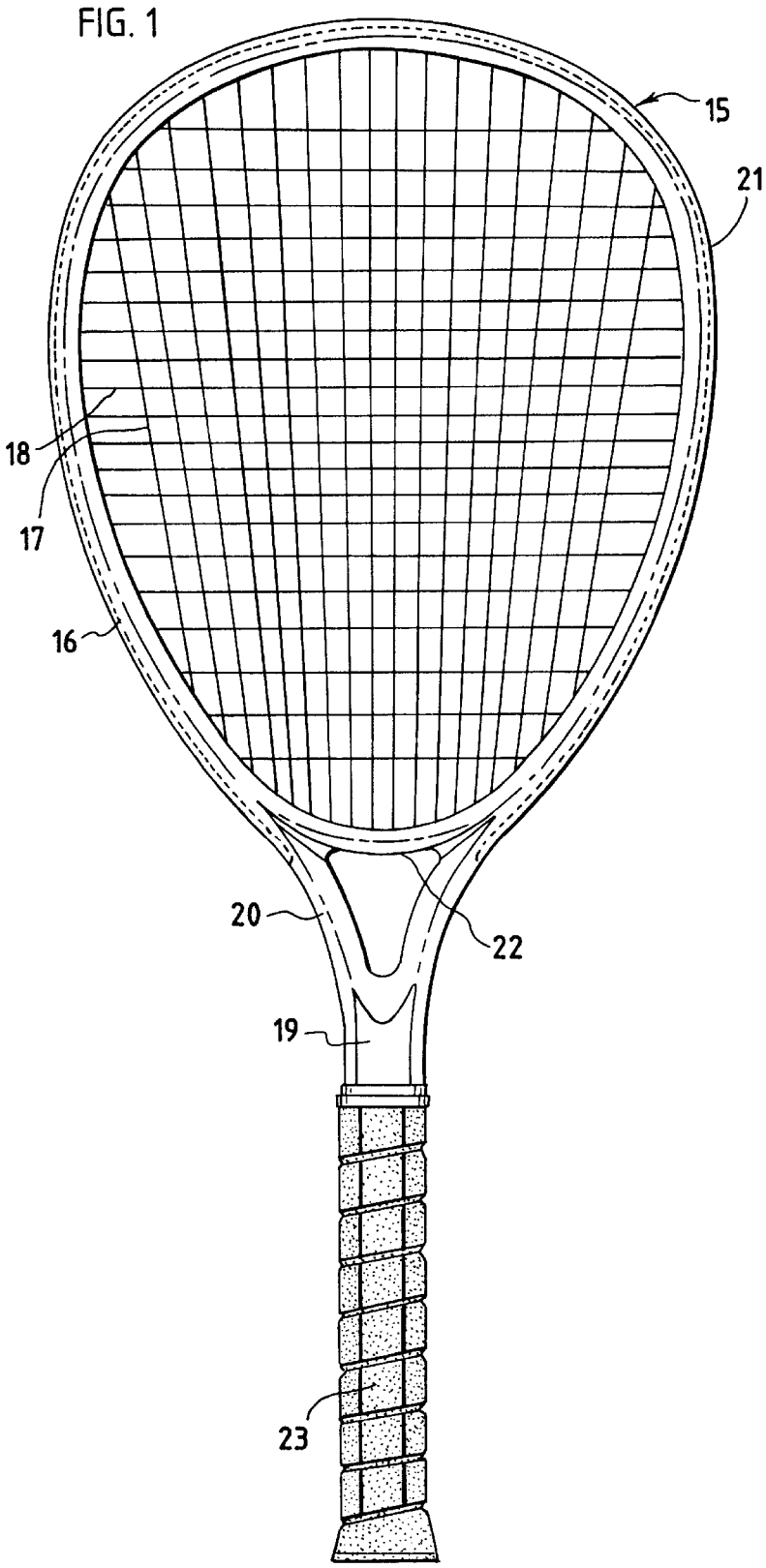
FIG. 1 is a front or plan view of a tennis racquet formed in accordance with the invention.

FIG. 1 illustrates a racquet 15 formed in accordance with the invention which has a string area of about 110 square inches.

The racquet includes a frame 16 and a generally planar string bed formed by longitudinal and transverse strings 17 and 18. The frame is formed from composite material consisting of fibers and resin. The fibers can be graphite, Keviar, or other fibers which are conventionally used in tennis racquets. The resin is conventional resin which is used in composite tennis racquets.

The frame includes an elongated shaft portion 19, a Y-shaped throat portion 20, and a head portion 21. A yoke 22 extends between the sides of the throat and forms the bottom of the head. A grip or handle 23 is formed at the lower end of the shaft by spirally wrapped grip material, and the grip terminates in a butt end 24 at the bottom of the racquet.

Figure 2:
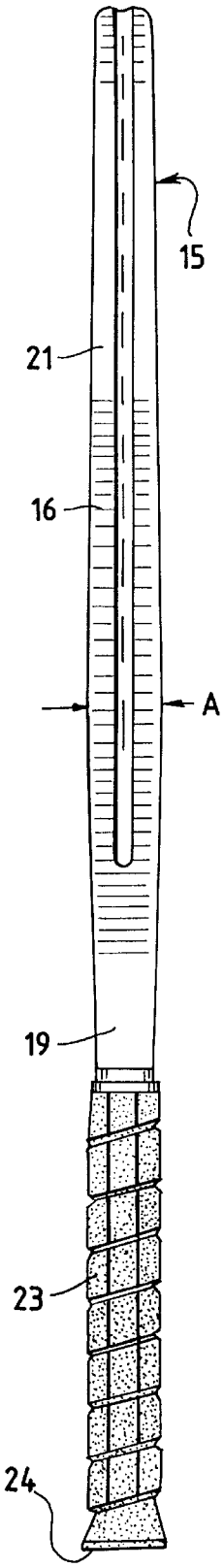
FIG. 2 is a side elevational view of the racquet.

As can be seen from the side elevational view of FIG. 2, the racquet 15 is a dual taper beam racquet. The widest or thickest portion of the frame above the grip is indicated by the dimension A and is in the area where the yoke 22 merges with the sides of the head.

Figure 3:
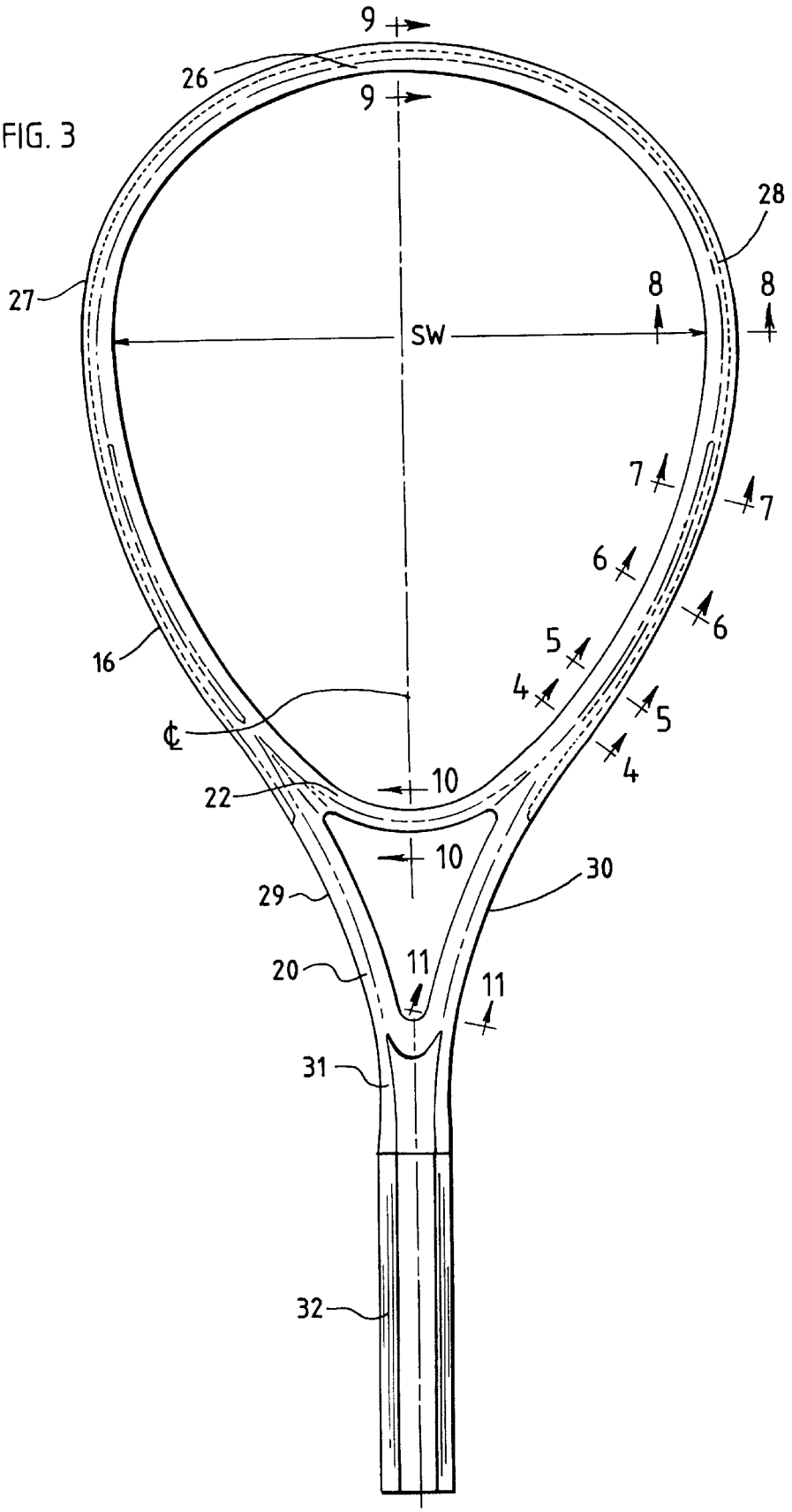
FIG. 3 is a plan view of the racquet frame.

Referring to FIG. 3, the frame 16 is molded in the conventional manner. A tube of fiber and uncured resin is formed into a so-called hairpin shape and placed in a mold. The middle portion of the hairpin-shaped tube forms the top portion 26 of the frame, and the tube curves downwardly in the shape of an inverted U to form the side portions 27 and 28 of the head and the two arms 29 and 30 of the Y-shaped throat. The two ends of the tube are wrapped with additional fiber and resin to form the shaft portion 31 and the handle portion or pallet 32. The yoke 22 is formed from a separate piece which is joined to the tube, for example, by tape formed from fiber and resin. When the mold is closed, the interior of the tube is pressurized and the mold is heated to cure the resin and form an integral frame.

The cross sectional shape of the frame at various locations is illustrated in FIGS. 4–11. The cross sections are shown as solid for ease and clarity of illustration, but it will be understood that the actual cross sections are hollow as is well known in the art. The frame is symmetrical, and the cross sections on both sides of the longitudinal centerline CL are the same.

Figure 4:
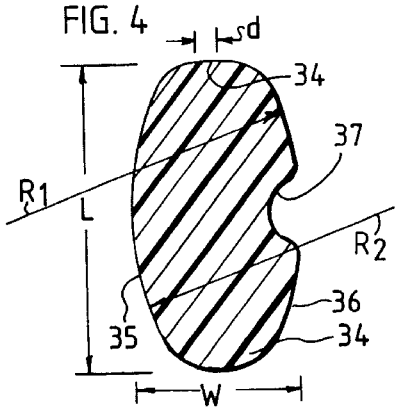
FIGS. 4 through 11 are sectional views of the racquet frame taken along the section lines indicated in FIG. 3.

FIG. 4 illustrates the cross section at line 4—4 of FIG. 3, which is just above the area where the yoke 22 merges with the inverted U-shaped portion of the head. The cross section is generally oval or elliptical, but the shape of the oval is wider and boxier than conventional cross sections. The cross section of the particular frame illustrated has a length L of 1.181 inch and a width W of 0.640 inch. Each width or short side of the oval has a flat portion 34 having a dimension d of 0.080 inch. The ratio of the width W to the length L is 0.542.

The inside surface 35 of the cross section curves along a radius $R_2$. The outside surface 36 curves along a radius $R_1$. except at a groove 37 for the strings.

Figure 5:
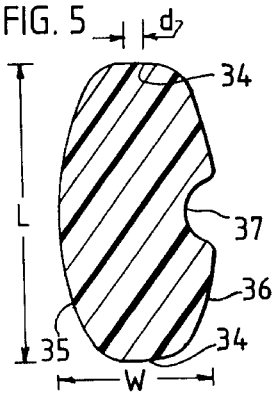
Figure 6:
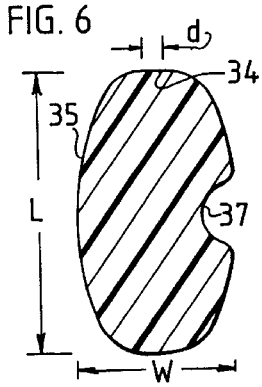
Figure 7:
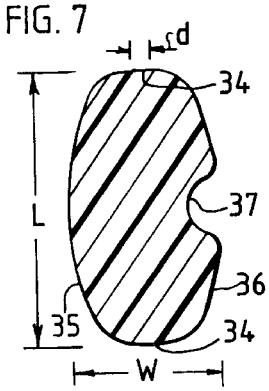
Figure 8:
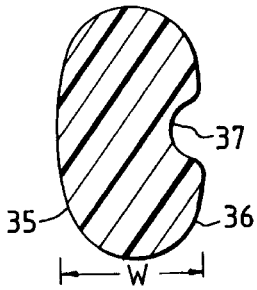
Figure 9:
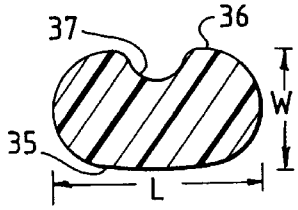
Figure 10:
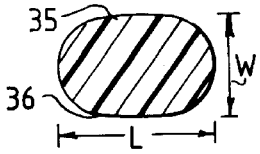
Figure 11:
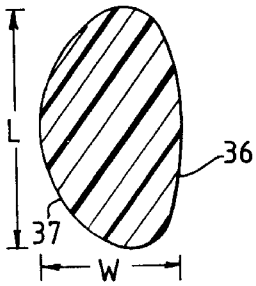

The cross sections in FIGS. 5–7 are also somewhat boxy but the length L and width W decrease in a direction toward the top of the frame. Each of the sections in FIGS. 5–7 includes parallel flats 34 having a dimension d of 0.080 inch.

The length dimensions of the cross section extend generally perpendicularly to the plane of the strings. The width dimensions and the parallel flats 34 extend generally parallel to the strings.

Racquet frames in accordance with the invention have been made in two lengths—27 inches and 28.5 inches. The actual length of the frames without the grip material as illustrated in FIG. 3 were 26.712 inches and 27.712 inches. Dimensions for the cross sections of FIGS. 4–11 of the frames are set forth in Table I and II.

TABLE I

| 27 Inch Frame | | | | | |
|---|---|---|---|---|---|
| Section | Width | Length | W/L | $R_1$ | $R_2$ |
| 4-4 | 0.640" | 1.181" | 0.542 | 1.163" | 1.163" |
| 5-5 | 0.596" | 1.159" | 0.514 | 1.163" | 1.163" |
| 6-6 | 0.596" | 1.105" | 0.539 | 1.163" | 1.163" |
| 7-7 | 0.576" | 1.046" | 0.551 | 1.163" | 1.163" |
| 8-8 | 0.550" | 0.945" | 0.582 | 1.163" | 1.163" |
| 9-9 | 0.460" | 0.787" | 0.584 | 1.163" | 1.163" |
| 10-10 | 0.430" | 0.700" | 0.614 | 1.163" | 1.163" |
| 11-11 | 0.534" | 0.938" | 0.569 | 1.163" | 0.528" |

TABLE II

| 28.5 Inch Frame | | | | | |
|---|---|---|---|---|---|
| Section | Width | Length | W/L | $R_1$ | $R_2$ |
| 4-4 | 0.640" | 1.181" | 0.542 | 1.163" | 1.163" |
| 5-5 | 0.636" | 1.143" | 0.556 | 1.163" | 1.163" |
| 6-6 | 0.624" | 1.105" | 0.565 | 1.163" | 1.163" |
| 7-7 | 0.606" | 1.046" | 0.579 | 1.163" | 1.163" |
| 8-8 | 0.565" | 0.961" | 0.588 | 1.163" | 1.163" |
| 9-9 | 0.460" | 0.827" | 0.556 | 1.163" | 1.163" |
| 10-10 | 0.430" | 0.700" | 0.614 | 1.163" | 1.163" |
| 11-11 | 0.534" | 0.972" | 0.549 | 1.163" | 0.568" |

The cross sections 9—9 and 10—10 are taken where the longitudinal centerline bisects the top of the head and the yoke, respectively. The width and length of the cross sections above the section 4—4 progressively decrease toward the top section 9—9. As indicated by the section 11—11, the width and length of the arms 29 and 30 of the throat also progressively decrease between the area of merger between the arms and the yoke and the shaft portion 31. The width and length of the cross sections of the arms is at a maximum adjacent said merger. The maximum length and width of the arms are about 1.061 and 0.541 inch, respectively.

The wider, boxier cross sections of the frames of this invention, particularly at section 4—4 just above the area of merger of the yoke and the sides of the head, can be appreciated by comparing the widths, lengths, and W/L ratios of prior racquets. For example, in the 95 square inch mode of the racquet described in U.S. application Ser. No. 569,348, the section 4—4 has a width of 0.6084 inch, a length of 1.257 inch, and a W/L of 0.484. The ratio of W/L between sections 4—4 and 9—9 does not exceed 0.484. In the 110 square inch model of the racquet, the section 4—4 has a width of 0.609 inch, a length of 1.457 inch, and a W/L of 0.418.

In Wilson's Sledge Hammer racquets, the section 4—4 has a width of 0.598 inch, a length of 1.227 inch, and a W/L of 0.487. Section 5—5 has a width of 0.575 inch, a length of 1.259 inch, and a W/L of 0.457. Section 7—7 has a width of 0.545 inch, a length of 1.164 inch, and a W/L of 0.4682. Section 8—8 has a width of 0.538 inch, a length of 1.087 inch, and a W/L of 0.495. W/L does not exceed 0.500 until above section 8—8. W/L at section 9—9 is 0.528.

In a racquet called Big Bang, a section comparable to section 4—4 has a width of 0.512 inch, a length of 1.265 inch, and W/L of 0.405. The ratio of W/L between sections 4—4 and 9—9 does not exceed 0.410. The arms of the throat have a width of 0.655 inch, a length of 1.220 to 1.240 inch, and a W/L of 0.537.

In a racquet called Extender Thunder, a section comparable to section 4—4 has a width of 0.460 to 0.525 inch, a length of 1.090 to 1.095, and a W/L of 0.420 to 0.486. The ratio of W/L above the area of merger of the yoke and the sides of the head does not exceed 0.486.

In a racquet called Extender Synergy, a section comparable to section 4—4 has a width of 0.450 to 0.525 inch, a length of 1.070 to 1.105 inch, and a W/L of 0.407 to 0.491. The ratio of W/L above the area of merger between the yoke and the sides of the head does not exceed 0.491.

If the width of the frame in the area just above the merger between the yoke 22, the arms 29 and 30 of the throat, and the sides 27 and 28 of the inverted U-shaped portion of the head is at least 0.600 inch, more preferably at least about 0.620 inch, and most preferably at least about 0.640 inch, then the frame has good torsion or resistance to twisting in the portion of the frame which is most subject to twisting. The shape of the cross section of the frame in that area is preferably generally oval or elliptical. However, the generally oval shape is relatively boxy as defined by the ratio of the width to the length of the cross section. The W/L ratio is advantageously at least 0.500 and more preferably at least about 0.540 to 0.542. Further, the ratio of W/L for the portion of the entire head above said merger should be at least as great as the ratio of W/L for the area just above the merger. A frame having such cross sections will exhibit both good torsion (resistance to twisting) and good stiffness (resistance to bending).

The increased width and boxy shape of the cross section in the area just above said merger may be further defined by flat portions 34 on the widths or short sides of the cross sections. The flat portions advantageously have a dimension d of at least about 0.080 inch long, or about ⅛ of the entire dimension of the width.

Figure 12:
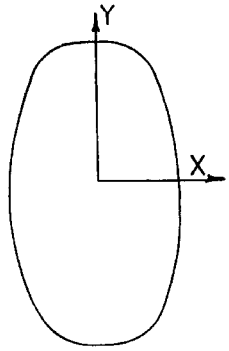
FIG. 12 is representative of a cross section of a racquet frame.

Even though the section 4—4 has a smaller L dimension than certain prior art racquets, for example, Wilson's Sledge Hammer racquet, the moment of inertia about the neutral axis and the resistance to bending, which is proportional to the moment of inertia, is substantial. FIG. 12 is representative of a section comparable to section 4—4 without the string groove. The x axis is the neutral axis for bending in a direction transverse to the plane of the strings. The moment of inertia about the x axis of a solid cross section having the dimensions of the section 4—4 of the frame 16 is about 5.964 to 5.998 ounce inches squared. The moment of inertia about the y axis is about 1.519 to 1.524 ounce inches squared.

The moment of inertia about the x axis of a solid cross section similar to FIG. 12 and having the dimensions of the Sledge Hammer 110 at section 4–4 is 4.885 ounce inches squared. The moment of inertia about the y axis is 1.061 ounce inches squared.

The moment of inertia of the inventive racquet is higher even though dimension L is smaller because of the wider, boxier shape. The shape places a substantial amount of material a substantial distance from the axis with respect to which the moment of inertia is measured.

A frame having a wider cross section in the area above said merger can have a wider head because of the increased strength of the frame. Referring to FIG. 3, the head 16 has a maximum string width SW of about 10.701 inch for a head size, i.e., strung surface area, of about 112 square inches. In contrast the maximum string width of the aforementioned prior art racquets was significantly less, as shown in Table III.

TABLE III

| Racquet | Maximum String Width | Head Size |
|---|---|---|
| Sledge Hammer 110 | 10.238 inches | 110 |
| Big Bang | 9.92 inches | 111 |
| Extender Thunder | 10.68 inches | 117 |
| Extender Synergy | 10.41 inches | 122 |

By enabling maximum string widths of greater than 10.68 inches and up to 10.701 inches and more for head sizes up to 122 square inches, the invention not only increases the width of the hitting area but also increases the polar moment of inertia of the racquet. The polar moment of inertia is measured with respect to the longitudinal centerline CL and is a measure of the resistance to twisting of the racquet on off-center hits. The polar moment of inertia of the racquet of the invention is at least about 100 ounce inches squared and preferably within the range of 101 to 108 ounce inches squared. Some prior art racquets increased the polar moment of inertia by adding weight to the frame away from the centerline. Racquets in accordance with the invention do not need to add as much weight to obtain the same polar moment of inertia. The polar moments of inertia of the aforementioned prior racquets are listed in Table IV.

TABLE IV

| Racquet | Polar Moment of Inertia (ounce inches squared) |
|---|---|
| Sledge Hammer 110 | 101 |
| Big Bang | 91.6 |
| Extender Thunder | 103.2 |
| Extender Synergy | 91.0 |

The Sledge Hammer 110 has more added weight for obtaining the polar moment of inertia than racquets in accordance with the invention.

The wider maximum string width of racquets in accordance with the invention also minimizes the difference between the maximum string width and the maximum string length. Referring to FIG. 3, the maximum string length along the centerline CL measured from the inside surfaces of the yoke 22 and the top of the head is 13.703 inches for a 27 inch racquet and 14.173 inches for a 28 inch racquet. The ratio of maximum string width to maximum string length is 0.781 and 0.755 for the 27 inch and 28 inch racquets, respectively. Minimizing the difference between maximum string width and length enables the string tension of the main and cross strings to be more uniform and increases the playability of the racquet.

The maximum string length and the ratio SW/SL of maximum string width to maximum string length of certain prior art racquets are listed in Table V.

TABLE V

| Racquet | Maximum String Length | SW/SL |
|---|---|---|
| Sledge Hammer 110 | 13.703 inches | 0.747 |
| Big Bang | 14.35 inches | 0.691 |
| Extender Thunder | 15.21 inches | 0.702 |
| Extender Synergy | 15.04 inches | 0.692 |
| Dunlop Revelation | 14.13 inches | 0.743 |

Even though the racquets in accordance with the invention have wider frame cross sections in certain areas and a wider maximum string width, the racquets can be made with a desirable light weight and have sufficient strength. The strung weight of the racquet can be less than 10 ounces or even less than 9 ounces. The strung weights of two specific 27 inch and 28.5 inch racquets made in accordance with the invention were about 9.2 ounces and 9.5 ounces, respectively.

While in the foregoing specification a detailed description of specific embodiments of the invention were set forth for the purpose of illustration, it will be understood that many of the details herein given can be varied considerably by those skilled in the art without departing from the spirit and scope of the invention.

We claim:

1. A tennis racquet comprising:

a frame having an elongated lower shaft portion, an upper head portion, and a generally planar string bed supported by the head portion, the shaft having a lower handle portion which terminates in a butt end and a generally Y-shaped upper throat portion formed by a pair of diverging arms, the head having a generally U-shaped upper portion which merges with said arms and which curves upwardly from said arms and a yoke portion which merges with said arms and which curves downwardly between said arms, the frame having a longitudinal centerline which extends along said handle portion and bisects the yoke portion and the upper portion of the head, the head having a top where the centerline bisects the upper portion of the head and a bottom where the centerline bisects the yoke, the upper portion of the head having a generally oval cross section with a length which extends generally perpendicularly to the plane of the string bed and a width which extends generally parallel to the plane of the string bed, the length and width of the cross section of the upper portion head being at a maximum adjacent the merger between said yoke and said arms and decreasing toward the top of the frame, the dimension of said maximum width being at least 0.620 inch, the ratio of said maximum width to said maximum length of the cross section of the upper portion of the head being at least 0.5.

2. The racquet of claim 1 in which the ratio of the maximum string width to the maximum string length of said string bed is 0.755.

3. The racquet of claim 2 in which the maximum string width of said string bed is at least 10.68 inches.

4. The racquet of claim 3 in which the strung weight of the racquet is less than 10 ounces.

5. The racquet of claim 1 in which the upper portion of the head includes a pair of parallel flat side portions which extend generally parallel to said string bed adjacent the merger between said yoke and said arms.

6. The racquet of claim 5 in which said parallel flat side portions have a dimension of at least 0.080 inch.

7. A tennis racquet comprising:

a frame having an elongated lower shaft portion, an upper head portion, and a generally planar string bed supported by the head portion, the shaft having a lower handle portion which terminates in a butt end and a generally Y-shaped upper throat portion formed by a pair of diverging arms, the head having a generally U-shaped upper portion which merges with said arms and which curves upwardly from said arms and a yoke portion which merges with said arms and which curves downwardly between said arms, the frame having a longitudinal centerline which extends along said handle portion and bisects the yoke portion and the upper portion of the head, the head having a top where the centerline bisects the upper portion of the head and a bottom where the centerline bisects the yoke, the upper portion of the head having a generally oval cross section with a length which extends generally perpendicularly to the plane of the string bed and a width which extends generally parallel to the plane of the string bed, the length and width of the cross section of the upper portion head being at a maximum adjacent the merger between said yoke and said arms and decreasing toward the top of the frame, the dimension of said maximum width being at least 0.620 inch, the ratio of said maximum width to said maximum length of the cross section of the upper portion of the head being at least 0.540.

8. The racquet of claim 7 in which the ratio of the maximum string width to the maximum string length of said string bed is at least 0.755.

9. The racquet of claim 7 in which the upper portion of the head includes a pair of parallel flat side portions which extend generally parallel to said string bed adjacent the merger between said yoke and said arms.

10. A tennis racquet comprising:

a frame having an elongated lower shaft portion, an upper head portion, and a generally planar string bed supported by the head portion, the shaft having a lower handle portion which terminates in a butt end and a generally Y-shaped upper throat portion formed by a pair of diverging arms, the head having a generally U-shaped upper portion which merges with said arms and which curves upwardly from said arms and a yoke portion which merges with said arms and which curves downwardly between said arms, the frame having a longitudinal centerline which extends along said handle portion and bisects the yoke portion and the upper portion of the head, the head having a top where the centerline bisects the upper portion of the head and a bottom where the centerline bisects the yoke, the upper portion of the head having a generally oval cross section with a length which extends generally perpendicularly to the plane of the string bed and a width which extends generally parallel to the plane of the string bed, the width of the cross section of the upper portion of the head being at a maximum adjacent the merger between said yoke and said arms and decreasing toward the top of the frame, the ratio of said maximum width to the length of the cross section of the upper portion of the head adjacent said merger being at least 0.5, the dimension of said maximum width being at least 0.600 inch.

11. The racquet of claim 10 in which the dimension of said maximum width is at least 0.620 inch.

12. The racquet of claim 10 in which the dimension of said maximum width is at least 0.640 inch.

* * * * *